US009717391B2

(12) United States Patent
Culbreath et al.

(10) Patent No.: US 9,717,391 B2
(45) Date of Patent: Aug. 1, 2017

(54) CLEANING SYSTEM

(71) Applicant: 3M INNOVATIVE PROPERTIES COMPANY, St. Paul, MN (US)

(72) Inventors: Mitchell E. Culbreath, St. Paul, MN (US); Philip J. Dumont, Roberts, WI (US); Trisha D. Adamson, Woodbury, MN (US)

( * ) Notice: Subject to any disclaimer, the term of this patent is extended or adjusted under 35 U.S.C. 154(b) by 481 days.

(21) Appl. No.: 14/367,120

(22) PCT Filed: Dec. 27, 2012

(86) PCT No.: PCT/US2012/071747
§ 371 (c)(1),
(2) Date: Jun. 19, 2014

(87) PCT Pub. No.: WO2013/101890
PCT Pub. Date: Jul. 4, 2013

(65) Prior Publication Data

US 2014/0373873 A1 Dec. 25, 2014

Related U.S. Application Data

(60) Provisional application No. 61/581,300, filed on Dec. 29, 2011.

(51) Int. Cl.
*A46B 11/00* (2006.01)
*A47L 13/26* (2006.01)

(52) U.S. Cl.
CPC ..... *A47L 13/26* (2013.01); *A46B 11/0003* (2013.01); *A46B 11/0006* (2013.01); *A46B 11/0065* (2013.01); *A46B 2200/3033* (2013.01)

(58) Field of Classification Search
CPC ..... A46B 11/0003; A46B 11/0006; A46B 11/0075; A46B 2200/3033; A47L 13/26; A61M 35/003; A61M 35/006
See application file for complete search history.

(56) References Cited

U.S. PATENT DOCUMENTS 2,642,065 A * 6/1953 Negri ..... A61M 35/006 401/134
3,556,667 A * 1/1971 Kaugman ..... A46B 11/0041 401/132

(Continued)

FOREIGN PATENT DOCUMENTS

| | | |
|---|---|---|
| CN | 2016-91314 | 1/2011 |
| WO | WO 00-53053 | 9/2000 |
| WO | WO 2004-056287 | 7/2004 |

OTHER PUBLICATIONS

International Search Report for PCT International Application No. PCT/US2012/071747, mailed on Apr. 24, 2013, 6 pages.

*Primary Examiner* — Jennifer C Chiang
*Assistant Examiner* — Bradley Oliver

(57) ABSTRACT

The disclosed cleaning system provides a system for storing and containing together a cleaning tool and cleaning ampoules, which contain the cleaning material, so that all the necessary parts of the cleaning system are easily stored and accessible for cleaning needs. In one embodiment, the cleaning system includes a cleaning tool and a cleaning ampoule. The cleaning tool includes a body with a working surface having scrubbing elements. The body has an ampoule receptacle. The cleaning ampoule contains a cleaning material. The cleaning ampoule includes a compartment and a cover for containing the cleaning material in the compartment. The ampoule receptacle is capable of holding the cleaning ampoule while the cleaning material is dispensed to the working surface from the cleaning ampoule.

7 Claims, 4 Drawing Sheets

(56) References Cited

U.S. PATENT DOCUMENTS

| | | | | | |
|---|---|---|---|---|---|
| 3,768,916 | A | | 10/1973 | Avery | |
| 3,891,331 | A | | 6/1975 | Avery | |
| 3,910,706 | A | | 10/1975 | Del Bon | |
| 4,183,684 | A | | 1/1980 | Avery, Jr. | |
| 4,925,327 | A | | 5/1990 | Wirt | |
| 4,943,176 | A | * | 7/1990 | Baker | A61M 35/003 132/320 |
| 5,288,159 | A | | 2/1994 | Wirt | |
| 5,308,180 | A | | 5/1994 | Pournoor | |
| 5,435,660 | A | | 7/1995 | Wirt | |
| 5,658,084 | A | | 8/1997 | Wirt | |
| 5,690,958 | A | * | 11/1997 | McGrath | A61M 35/006 424/405 |
| 5,915,868 | A | * | 6/1999 | Frazell | A46B 11/0003 401/132 |
| 7,540,681 | B2 | | 6/2009 | Cybulski | |
| 8,105,306 | B2 | | 1/2012 | Davis | |
| 8,425,133 | B2 | | 4/2013 | Grez | |
| 8,979,785 | B2 | | 3/2015 | Korogi | |
| 2003/0002913 | A1 | | 1/2003 | Amit | |
| 2004/0267182 | A1 | | 12/2004 | Davis | |
| 2005/0260028 | A1 | | 11/2005 | Gu | |
| 2006/0135464 | A1 | | 6/2006 | Johnson | |
| 2006/0159509 | A1 | * | 7/2006 | Grez | A46B 11/0003 401/123 |
| 2006/0171767 | A1 | | 8/2006 | Hoadley | |
| 2007/0147946 | A1 | | 6/2007 | Cybulski | |
| 2008/0008728 | A1 | * | 1/2008 | Atkin | A46B 11/0006 424/401 |
| 2009/0044356 | A1 | * | 2/2009 | Noble | A46B 11/0003 401/123 |
| 2009/0197220 | A1 | | 8/2009 | Cindrich | |
| 2011/0066121 | A1 | | 3/2011 | Hoang | |
| 2012/0087711 | A1 | | 4/2012 | Wolfe | |
| 2013/0252206 | A1 | * | 9/2013 | Lee | A46B 11/0003 433/216 |

* cited by examiner

CLEANING SYSTEM

CROSS-REFERENCE TO RELATED APPLICATION

The present application claims priority to U.S. Provisional Patent Application Ser. No. 61/581,300 filed 29 Dec. 2011 and is herein incorporated by reference.

FIELD

The present disclosure relates to a cleaning system. In particular, the present disclosure relates to a cleaning system comprising a cleaning tool and at least one cleaning ampoule for dispensing cleaning material to a working surface of the cleaning tool.

BACKGROUND

It is common to use cleaning chemicals on fabric or other surfaces to remove soiling or stains. Cleaning chemicals are often liquid chemicals contained in a spray or squirt bottle. However, there are also dry or powdered cleaning chemicals with very low moisture content that are used for cleaning. Sometimes a brush is used to thoroughly spread the cleaning chemical onto the fabric or other surface. If the chemical is dry or powdered, a vacuum can be used to remove the soiled powder from the surface being cleaned. This process for cleaning requires many separate components that a user must gather together and store for future use.

SUMMARY

The disclosure herein relates generally to systems for cleaning and methods of using the same. Generally, the disclosure herein pertains to a cleaning system including a cleaning tool configured to dispense cleaning material located within a cleaning ampule to a working surface. Further, the disclosure provides a system for storing and containing together the cleaning tool and cleaning ampoules, which contain the cleaning material, so that all the necessary parts of the cleaning system are easily stored and accessible for cleaning needs.

In one exemplary embodiment, the cleaning system includes a cleaning tool and a cleaning ampoule. The cleaning tool includes a body with a working surface which may include scrubbing elements (e.g., a plurality of scrubbing elements). The body further includes an ampoule receptacle. The cleaning ampoule contains a cleaning material. The cleaning ampoule may include a compartment and a cover configured to contain the cleaning material in the compartment. The ampoule receptacle may be capable of holding the cleaning ampoule while the cleaning material is dispensed to the working surface from the cleaning ampoule. The scrubbing elements may include any suitable scrubbing/cleaning material including bristles, stems, hooks (e.g., or, for example, other materials such as loops, non-woven material, woven fabric, knitted fabric), or combinations thereof. The body of the cleaning tool may include a storage portion for holding a plurality of cleaning ampoules.

In one or more embodiments, the cleaning tool may include a handle (e.g., to assist in holding during use, or for utilizing features of the handle in a storage mode). In one or more embodiments the cleaning material may include liquid cleaning material, solid cleaning material, or combinations thereof (e.g., any suitable cleaning composition).

The cleaning ampoule may include a midsection with a first end and a second end, the cleaning compartment may be cylindrical (but is not limited to, and may be any suitable geometry). Further, a portion of the cover may be displaced to dispense the cleaning material from the cleaning ampoule, and the cover may be in the form of a punctureable film or at least a portion of the cover may be removable from the cleaning ampoule. Further, the cover may be proximate or adjacent at least one of a first end or second end of the cleaning ampoule, in other embodiments the cover may be over a midsection of the cleaning ampoule. In an arrangement wherein the cover is over a midsection of the cleaning ampoule, the cleaning ampoule midsection may include an apertured sidewall configured to dispense the cleaning material from the cleaning ampoule. The ampoule receptacle may include at least one pin (or other suitable feature) configured to puncture the cover.

In one or more embodiments, the ampoule receptacle is proximate or adjacent an upper surface opposite the working surface, and the ampoule receptacle may provide a passage of the cleaning material from the cleaning ampoule to the working surface. Further, the ampoule receptacle may receive either an end of the ampoule, or a longitudinal length of the ampoule.

In one or more embodiments, the ampoule receptacle may be located in-between a plurality of scrubbing elements at the working surface (e.g., for example, proximate or adjacent the working surface), and the cleaning ampoule may be rotatably mounted in the ampoule receptacle. Further, one or more wheels may be provided adjacent (e.g., for example, proximate, within or protruding from) the ampoule receptacle, wherein the wheels are configured to rotate the cleaning ampoule.

In one or more embodiments of a cleaning system, the cleaning tool may include a body wherein the body may include a working surface with scrubbing elements and an upper surface, opposite the working surface, and wherein the body has an ampoule receptacle at (e.g., for example, proximate or adjacent) the upper surface. The cleaning tool may also include a cleaning ampoule that may contain a cleaning material. Further, for example, the cleaning ampoule may include a compartment at a midsection of the cleaning ampoule and a cover at (e.g., proximate or adjacent) at least one of a first end or second end of the cleaning ampoule configured to contain the cleaning material in the compartment. The ampoule receptacle may be capable of holding the cleaning ampoule. The ampoule receptacle may provide a fluid pathway of the cleaning material from the cleaning ampoule to the working surface. Further, the cover may include a punctureable film and the ampoule receptacle may comprise at least one pin (or other feature) configured to puncture the film and may provide a fluid pathway of the cleaning material from the cleaning ampoule to the working surface.

In one or more embodiments of a cleaning system, the cleaning tool includes a body wherein the body may include a working surface including a plurality of scrubbing elements. Further, the body may include an ampoule receptacle located in-between a plurality of scrubbing elements at the working surface (e.g., for example, proximate, adjacent, coinciding, intermingled with, or located within the plane of the working surface or scrubbing elements). The ampoule receptacle may be bounded or partially bounded in the plane of the working surface by the plurality of scrubbing elements (e.g., bordered, surrounded). The cleaning ampoule contains a cleaning material, wherein the cleaning ampoule may include a cylindrical compartment and a cover over a midsection of the cylindrical compartment configured to contain the cleaning material in the compartment. The ampoule receptacle may be capable of rotatably holding the cleaning ampoule while the cleaning material is dispensed to the working surface from the cleaning ampoule. Further, the cover may include a cover wrap that is removable from the midsection leaving an apertured sidewall configured to dispense the cleaning material from the cleaning ampoule (e.g., to the working surface or to the surface to be cleaned (e.g., directly or indirectly)).

An exemplary method of cleaning is also described. For example, the method may include: providing a cleaning tool wherein the cleaning tool may include a body, wherein the body may include a working surface with a plurality scrubbing elements including bristles, stems, hooks, or combination thereof (or any other materials as previously described above), further wherein the body may include an ampoule receptacle, further wherein the body of the cleaning tool may include a storage portion for holding a plurality of cleaning ampoules; providing a cleaning ampoule which may contain a cleaning material (e.g., wherein the cleaning ampoule may include a compartment and a cover configured to contain the cleaning material in the compartment); inserting the cleaning ampoule into the ampoule receptacle; displacing at least a portion of the cover; and dispensing the cleaning material from the cleaning ampoule to the working surface.

In one or more exemplary embodiments of the method, the method may further include one or more of the following: puncturing the cover upon inserting the cleaning ampoule into the ampoule receptacle; providing a cover including a wrap over an apertured side wall of the cleaning ampoule; or sliding the working surface of the cleaning tool over a surface to be cleaned and rotating the cleaning ampoule while dispensing the cleaning material.

The terms "comprises" and variations thereof do not have a limiting meaning where these terms appear in the description and claims.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION OF EXEMPLARY EMBODIMENTS

In the following detailed description of illustrative embodiments, reference is made to the accompanying figures of the drawings which form a part hereof, and which are shown, by way of illustration, specific embodiments which may be practiced. It is to be understood that other embodiments may be utilized and structural changes be made without departing from (e.g., still falling within) the scope of the disclosure presented hereby.

Exemplary cleaning systems and methods regarding the same, for example, such as methods regarding the use of such cleaning systems shall be generally described with reference to FIGS. 1-10. It will be apparent to one skilled in the art that elements from one embodiment may be used in combination with elements of the other embodiments, and that the possible cleaning, ampoule design and ampoule storage features of the embodiments using features set forth herein are not limited to the specific embodiments described. Further, it will be recognized that the embodiments described herein will include many elements that are not necessarily shown to scale. Further, it will be recognized that the size and shape of various elements herein may be modified without departing from the scope of the present disclosure, although one or more shapes and sizes may be advantageous over others.

Figure 1:
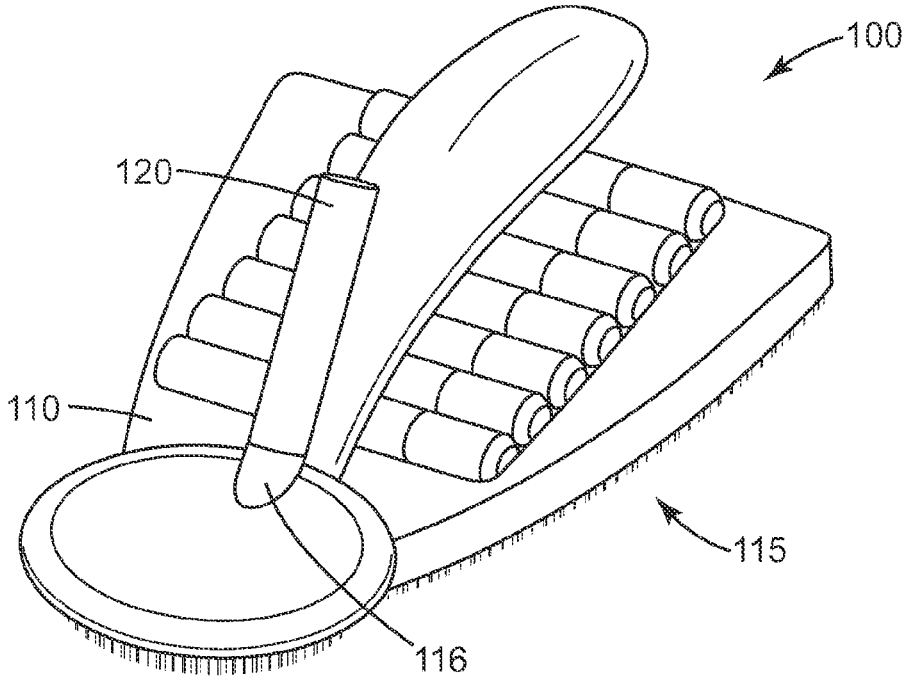
FIG. 1 is perspective view of a first embodiment of a cleaning system.
Figure 2:
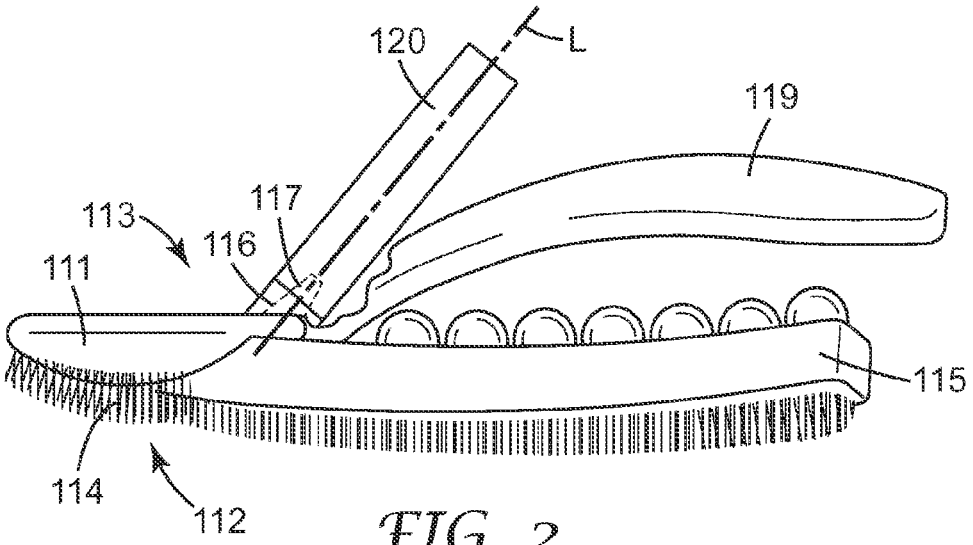
FIG. 2 is a side view of the cleaning system of FIG. 1.
Figure 3:
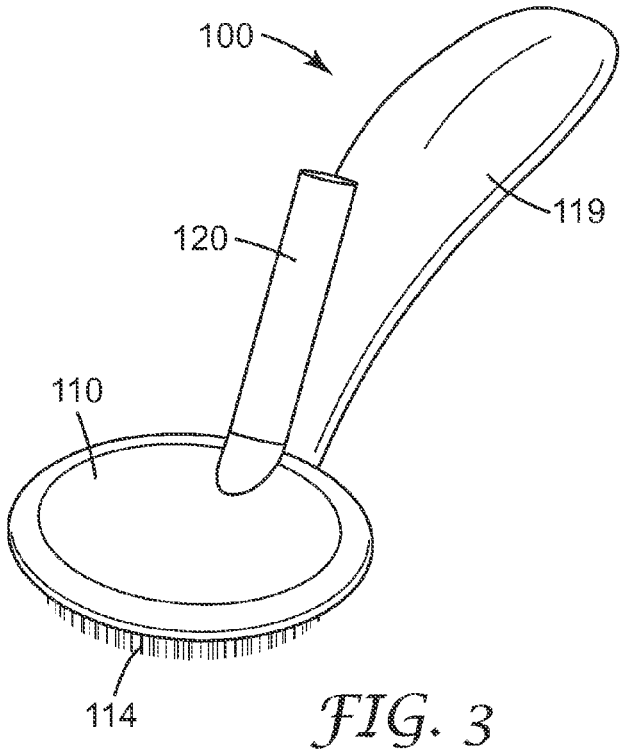
FIG. 3 is a perspective view of the cleaning system of FIG. 1 with the storage portion removed.
Figure 4:
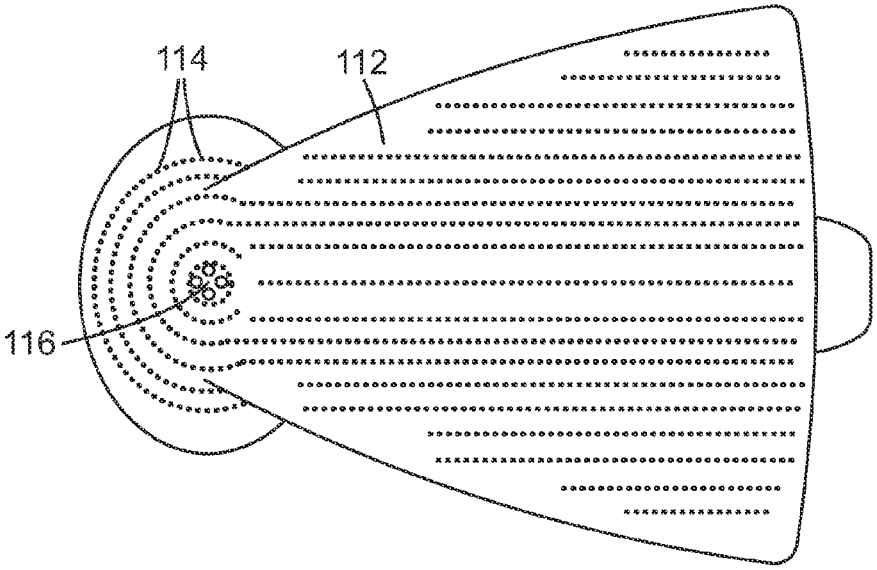
FIG. 4 is a bottom view of the cleaning system of FIG. 1.

FIGS. 1-4 show an exemplary embodiment of a cleaning system 100. FIG. 1 is a perspective view of a cleaning system 100. FIG. 2 is a side view of the cleaning system 100 of FIG. 1. FIG. 3 is a perspective view of the cleaning system 100 of FIG. 1 with the storage portion 115 removed. FIG. 4 is a bottom view of the cleaning system 100 of FIG. 1. The cleaning system 100 includes a cleaning tool 110 and an ampoule 120 containing a cleaning material. The cleaning tool 110 includes a body 111 with a working surface 112 that comes into contact with the surface to be cleaned and an upper surface 113, opposite the working surface 112.

On at least a portion of the working surface 112 is a plurality of scrubbing elements 114. The scrubbing elements 114 spread and disperse the cleaning material to the surface being cleaned. The scrubbing elements 114 may be bristles, stems, hooks, loops, nonwoven material, woven fabric, knitted fabric, or any other suitable material or geometry (herein, the scrubbing elements may refer to the individual fibers as in nonwoven material, woven fabric, knitted fabric, etc., thus, one piece of material may contain a plurality of scrubbing elements). There may be one or more materials for the scrubbing elements 114 over the working surface 112. The different materials may be interspersed across the working surface 112, or the different materials may be in isolated sections of the working surface 112. For example, both long and short bristles may be used as scrubbing elements 114 (e.g., for example, different lengths of bristles, stems, hooks, loops, nonwoven material, woven fabric, knitted fabric, or combinations thereof). For example, one portion of the working surface may comprise bristles (e.g. for example, long bristles, short bristles, or both) while another portion may comprise looped material (e.g., long loops, short loops or both), or they may be interspersed. Any combination of material specifications suitable to cleaning may be provided.

The body 111 includes a storage portion 115. The storage portion 115 may be integrally connected with the body 111 or may be removable from the body 111. FIG. 3 shows the cleaning system 100 with the storage portion 115 removed from the body 111. The storage portion 115, when connected with the body 111 may include a plurality of scrubbing elements 114 at the working surface 112. In one or more embodiments, a plurality of ampoules 120 are contained (e.g., for example, stored, housed or attached by any suitable means) at the upper surface 113 of the body 111 (e.g., adjacent, proximate, within or partially within) the storage portion 115. It is understood that a variety of mechanical or adhesive fastening elements (e.g., mechanical pressure fit, glue, temporary/reusable adhesive, hook and loop fasteners, non-flexible or flexible straps, clips or brackets, etc.) could be utilized to ensure containment of the ampoules 120 while in the storage portion 115. For example, as shown in FIGS. 1-3, a mechanical pressure fit contains the ampoules 120.

In one exemplary embodiment, at the upper surface 113 of the body 111 is an ampoule receptacle 116. The ampoule receptacle 116 securely holds the ampoule 120 during use and provides a passage of the cleaning material contained within the ampoule 120 to the working surface 112. In this embodiment, the ampoule receptacle comprises one or more pins 117 for puncturing into the ampoule 120, while allowing for passage of the cleaning material contained within the ampoule 120 to the working surface 112 (e.g., the pin(s) may be of any suitable form capable of puncturing or otherwise providing a passage of the cleaning material contained within the ampoule 120 to the working surface 112, including any geometry or material other than a pin, e.g., a hollow cylinder, a spear or arrow, a knife, a triangular or pyramidal structure, an x-shaped projection, etc.). As shown in this embodiment, the ampoule receptacle 116 secures to one end of the ampoule 120 (e.g., using any suitable method of securing, for example, threaded features, press fit, adhesive, any type of fastener, etc.) resulting in the ampoule 120 longitudinally extending away from the body 111 (e.g., extending away along axis L).

In one or more embodiments, the cleaning tool 110 may include a handle 119 to aid a user in holding the cleaning tool 110 during use. As shown in this embodiment, the handle 119 projects outward and away from the cleaning tool 110 in a direction away from the working surface 112. It is understood that a variety of configuration of handles may be used that aid in allowing the user to grip the cleaning tool 110. In some embodiments, a projecting handle might not be included and instead molded and contoured portions of the cleaning tool 110 itself may provide adequate gripping.

Figure 8:
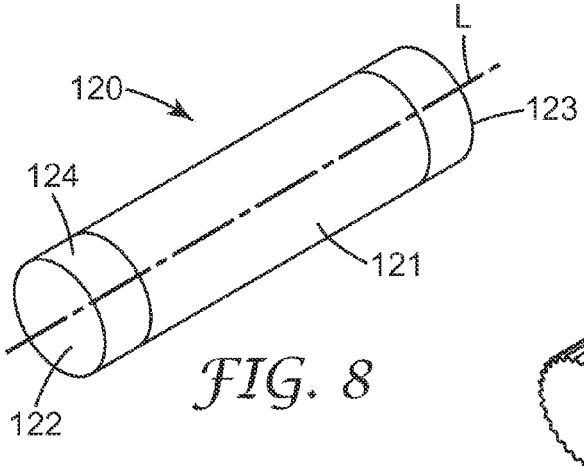
FIG. 8 is a perspective view of a first embodiment of a cleaning ampoule.

One exemplary embodiment of an ampoule is depicted in FIG. 8. The ampoule 120 comprises a compartment 121 (e.g., along axis L) between a first end 122 and second end 123 configured to hold the cleaning material. The first end 122 or second end 123 includes a cover 124, which may be durable (e.g., resists damage during normal handling, or is not easily punctured) along with a punctureable film. The ampoule may be made of any suitable material (e.g., for example, plastic, glass, metal, composites), and may include flexible or rigid material properties, or a combination thereof.

Referring to FIGS. 1-4, and FIG. 2 in particular, in one exemplary embodiment of a cleaning system, the pin 117 of the ampoule receptacle 116 engages with the first end 122 (or second end) to provide a passage of the cleaning material contained within the ampoule 120 to the working surface 112. For example, the pin 117 may puncture a punctureable cover 124 of the ampoule 120. If a durable cover (e.g., for example, a removable secondary cover adhesively attached to the punctureable cover 124, or a cap over the punctureable cover 124, etc.) is included, the cover might be first removed or might be available to cover the punctured cover 124 if the ampoule 120 will be used again.

The ampoule 120 may be of a size to contain cleaning material for a single use or may be of a size to contain the cleaning material for multiple uses. The cleaning material contained within the ampoule 120 may be a liquid cleaning material, a solid cleaning material, or combinations thereof. Although a longitudinal, cylindrical shaped ampoule is shown it is understood that any variety of sizes and shapes of containers may be suitable as ampoule 120. For example, any suitable form capable of containing the selected cleaning material, including a cube shape or a cylinder with a width greater than it length, or an irregular shape, including, shapes that are complimentary to mating components of the cleaning system may be suitable.

In an exemplary embodiment of the cleaning system, to use the cleaning system 100, an ampoule 120 is removed from the storage portion 115, if included. If a durable cover is included, the cover is removed. Then the ampoule 120 is inserted in to the ampoule receptacle 116 where the pin 117 inserts (e.g., by puncture or otherwise creating an opening) though the cover 124 into the ampoule 120. The cleaning material contained within the ampoule 120 passes through the ampoule receptacle 116 to the working surface 112. The working surface 112, containing the cleaning material, is passed over the surface being cleaned. The scrubbing elements 114 interact with the surface being cleaned and aid to disperse the cleaning material over the surface being cleaned.

Figure 5:
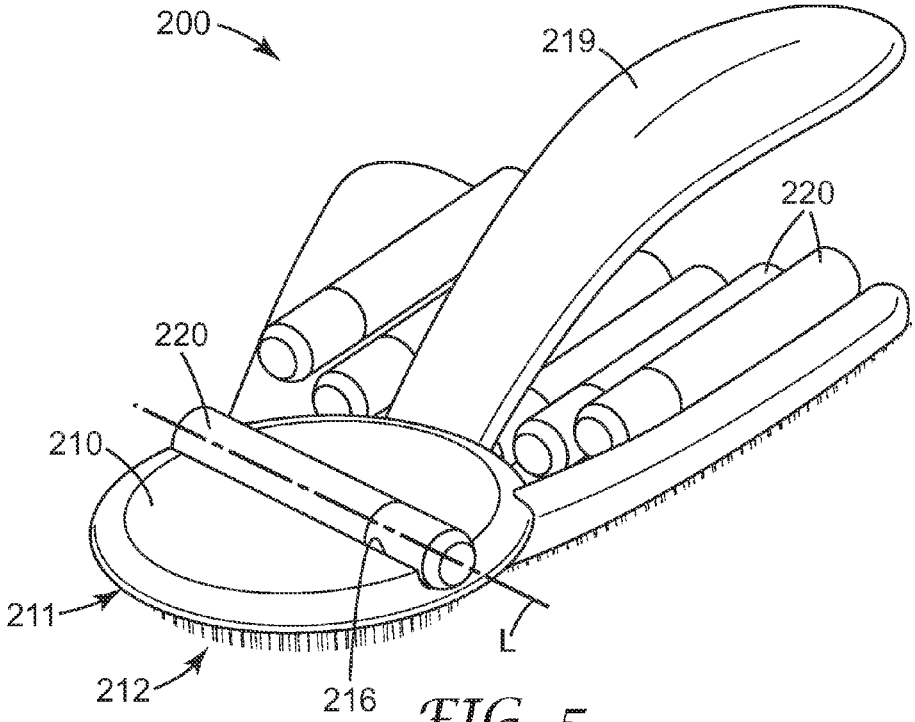
FIG. 5 is a perspective view of a second embodiment of a cleaning system.

FIG. 5 is a perspective view of a second embodiment of a cleaning system 200. The cleaning system 200 is similar to the cleaning system 100 depicted in FIGS. 1-4. The cleaning system 200 includes a cleaning tool 210 and an ampoule 220 containing a cleaning material. The cleaning tool 210 may include a body 211 including a working surface 212 that comes into contact with the surface to be cleaned and an upper surface 213, opposite the working surface 212. In one or more embodiments, the plurality of ampoules 220 contained in the storage portion 115 may be arranged to be generally parallel to the direction of the handle 219 (though they may be in any orientation suitable for inserting, removing and/or storing the ampoules). In one or more embodiments the ampoule receptacle 216 allows for receiving the ampoule 220 in a longitudinal manner such that the longitudinal length of the ampoule 220 (e.g., the length of the ampoule along axis L) makes contact along the longitudinal length of the ampoule receptacle (e.g., the length of the ampoule receptacle along axis L as shown in FIG. 5) instead of an end like contact as shown in FIGS. 1-4.

In one or more embodiments, the ampoule receptacle 216 may include one or more pins similar to that shown in FIGS. 1-4 that engage with the outer portion of the ampoule 220 to provide passage of the cleaning material contained within the ampoule 220 to the working surface 212. Another exemplary manner of providing passage of the cleaning material contained within the ampoule 220 to the working surface 212 may be as shown in FIG. 5, the ampoule receptacle 216 itself may be a slot narrower that the width of the ampoule 220 such that the ampoule receptacle 216 engages with and punctures an outer portion of the ampoule 220 allowing passage of the cleaning material contained within the ampoule 220 to the working surface 212.

In one or more embodiments, the ampoule 220 may be provided in any suitable form, including in the form of ampoule 120 as shown in FIG. 8. Ampoule 220 (which may be provided in the form of Ampoule 120 as described here) may include a compartment 121 between a first end 122 and second end 123 for holding the cleaning material. In this embodiment, the compartment 121 may be constructed of a punctureable material.

Figure 6:
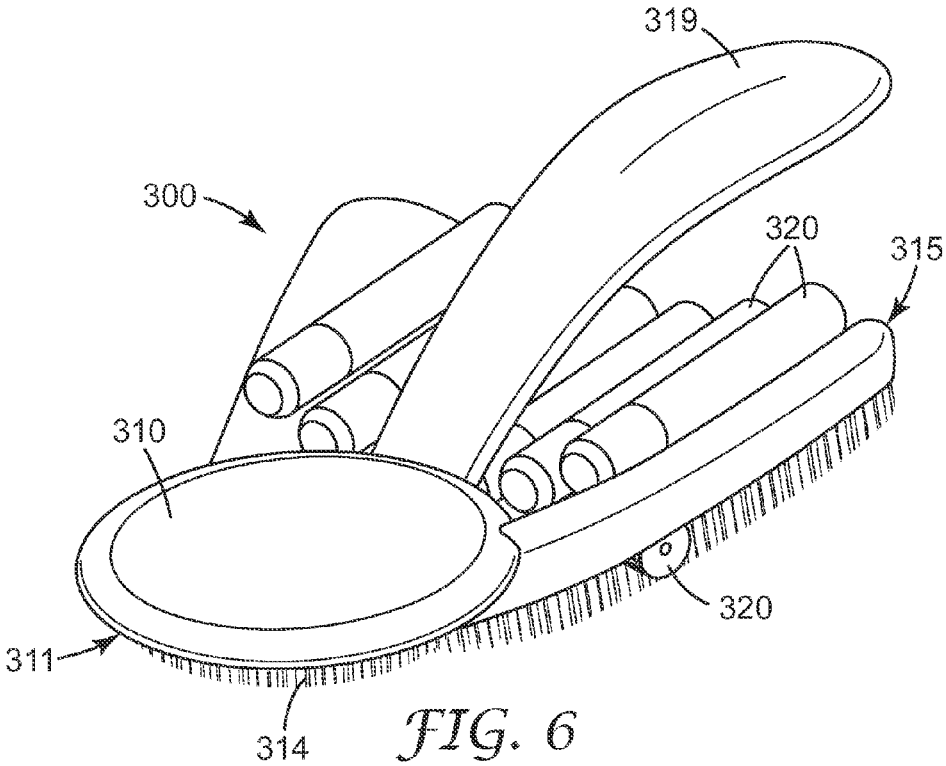
FIG. 6 is perspective view of a third embodiment of a cleaning system.
Figure 7:
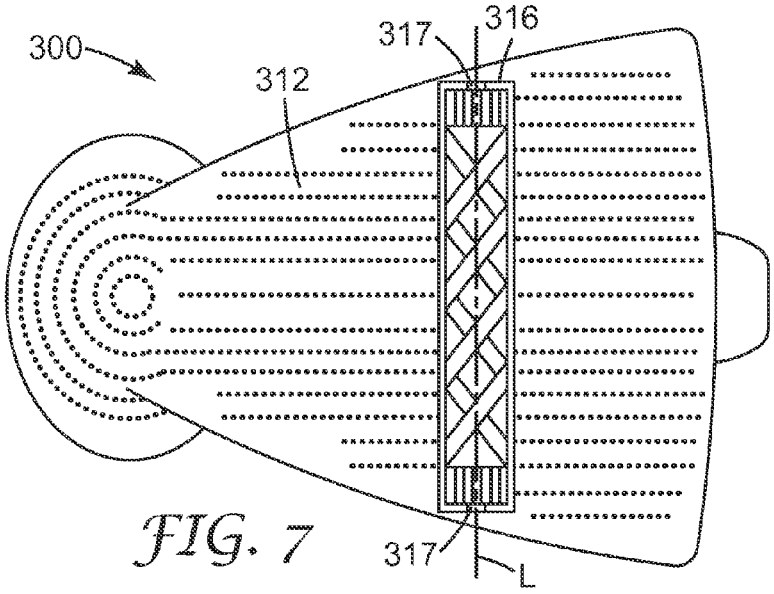
FIG. 7 is a bottom view of the cleaning system of FIG. 6.

FIG. 6 is perspective view of a third embodiment of a cleaning system 300. FIG. 7 is a bottom view of the cleaning system 300 of FIG. 6. The cleaning system 300 includes a cleaning tool 310 and an ampoule 320 containing a cleaning material. The cleaning tool 310 has a body 311 with a working surface 312 that comes into contact with the surface to be cleaned and an upper surface 313, opposite the working surface 312. The cleaning system 300 is similar to the cleaning system shown in the embodiments depicted in FIGS. 1-5. However, in one or more embodiments, the ampoule receptacle 316 may be configured to rotatably hold the ampoule 320 at the working surface 312 (e.g., for example, the ampoule receptacle may be proximate, adjacent, located within or near the vicinity of the working surface 312 (e.g., coinciding, intermingled with, or residing partially within the same or substantially same plane as the work surface 312 and/or scrubbing elements 314, or proximate and substantially parallel to the plane of the working surface 312 and/or scrubbing elements 314).

As shown in FIGS. 6-7, the ampoule receptacle 316 may be located inbetween a plurality of scrubbing elements (e.g., for example, amongst, proximate or adjacent) the working surface 312. In other words, the ampoule receptacle 316 may be bounded or partially bounded by the plurality of scrubbing elements 314 (e.g., bordered, surrounded). In one or more embodiments, the ampoule receptacle 314 may be bounded or partially bounded in the plane of the working surface 312 or in a plane substantially parallel to the working surface 312 by the plurality of scrubbing elements 314, the working surface, the body 311, or a combination of these elements. The ampoule receptacle 316 is shown at the storage portion 315 as located within the working surface 312, but may also be located at the main body 311 at the working surface 312. As discussed, the ampoule receptacle 316 may be configured to rotatably hold the ampoule 320. For example, the first end 322 and second end 323 of the ampoule 320 may be supported by a projecting portion 317 that allow for rotation about the projecting portion 317 but also provide a mechanical engagement to retain the ampoule 320 (e.g., including any suitable projecting portion 317 capable of allowing for retention and/or rotation of the ampoule 320, including various forms, shapes, materials, springs, mechanisms, etc.).

Figure 10:
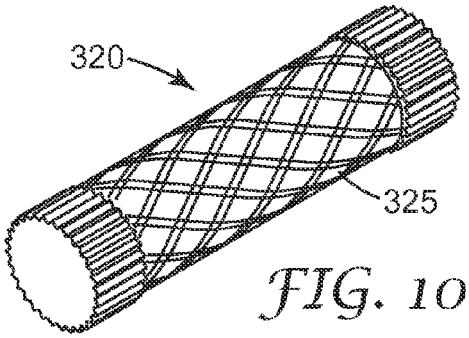
FIG. 10 is a perspective view of the cleaning ampoule of FIG. 9 with the cover wrap removed.

In one or more embodiments, one or more of the following features may be included to aid in rotation of the ampoule 320: the ampoule 320 may be cylindrical; the first end 322 and second end 323 may include outward projections or gear-like projections as shown on the ampoule in FIG. 10, to better make contact with the surface being cleaned; or one or more wheels may be placed adjacent (directly or indirectly) the first end 322 and/or second end 323 of the ampoule 320 such that rotation of the wheel(s) over the surface being cleaned causes rotation of the ampoule 320 (e.g., the one or more wheels may be configured to rotate the cleaning ampoule, for example, the one or more wheels may be located in, protruding from or adjacent to the ampoule receptacle 316 in any manner sufficient to promote cleaning).

Figure 9:
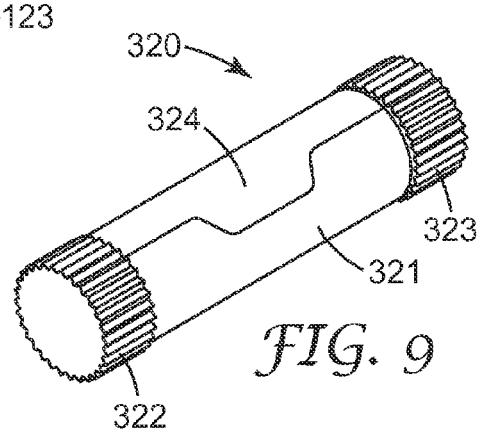
FIG. 9 is a perspective view of a second embodiment of a cleaning ampoule.

Further, in one or more embodiments of an ampoule 320 suitable for use in the embodiment shown in FIGS. 6-7 is shown in FIGS. 9 and 10. The ampoule 320 may include a compartment 321 between a first end 322 and second end 323 for holding the cleaning material. Prior to use, the compartment 321 is covered with a cover wrap 324. The cover wrap 324 is removable (e.g., the cover wrap may include temporary adhesive on its surface or perforations in the cover material such that all or some of it may be removed, etc.) to expose the underlying apertured sidewall 325. The apertured sidewall 325 allows for the cleaning material contained within to be dispensed to the working surface 312.

To use the cleaning system 300, an ampoule 320 is removed from the storage portion 315, if included. The cover wrap 324 may be removed and the ampoule 320 may be inserted into the ampoule receptacle 316. The projecting portions 317 (e.g., projecting portions of any suitable form, as previously described) engage with the first end 322 and second end 323 of the ampoule 320 and may rotatably support the ampoule 320. The user passes the working surface 312 over the surface to be cleaned causing rotation of the ampoule 320, which causes the cleaning material to dispense from the ampoule 320, through the apertured sidewall 325 and to the working surface 312. The user continues to pass the working surface 312 over the surface being cleaned continuing rotation of the ampoule and dispensing of the cleaning material. The scrubbing elements 314 interact with the surface being cleaned and aid to disperse the cleaning material over the surface being cleaned.

Illustrative Embodiments: Series A

1. A cleaning system comprising:

a cleaning tool comprising a body having a working surface with scrubbing elements and wherein the body has an ampoule receptacle;

a cleaning ampoule containing a cleaning material, wherein the cleaning ampoule comprises a compartment and a cover for containing the cleaning material in the compartment;

wherein the ampoule receptacle is capable of holding the cleaning ampoule while the cleaning material is dispensed to the working surface from the cleaning ampoule.

2. The cleaning system of embodiment 1, wherein the body of the cleaning tool includes a storage portion for holding a plurality of cleaning ampoules.

3. The cleaning system of any one of the preceding embodiments, wherein the cleaning tool further comprises a handle.

4. The cleaning system of any one of the preceding embodiments, wherein the scrubbing element comprise bristles, stems, hooks, loops, nonwoven material, woven fabric, knitted fabric, or combinations thereof.

5. The cleaning system of any one of the preceding embodiments, wherein the cleaning material is liquid cleaning material or a solid cleaning material.

6. The cleaning system of any one of the preceding embodiments, wherein the cleaning ampoule includes a midsection with a first end and a second end.

7. The cleaning system of embodiment 6, wherein the compartment is cylindrical.

8. The cleaning system of any one of the preceding embodiments, wherein at least a portion of the cover is displaced to dispense the cleaning material from the cleaning ampoule.

9. The cleaning system of any one of the preceding embodiments, wherein the cover is a punctureable film.

10. The cleaning system of any one of the preceding embodiments, wherein at least a portion of the cover is removable from the cleaning ampoule.

11. The cleaning system of any one of the preceding embodiments, wherein the cover is at at least one of the first end or second end of the cleaning ampoule.

12. The cleaning system of any one of the preceding embodiments, wherein the cover is over a midsection of the cleaning ampoule.

13. The cleaning system of embodiment 12, wherein the cleaning ampoule at the midsection includes an apertured sidewall for dispensing the cleaning material from the cleaning ampoule.

14. The cleaning system of any one of the preceding embodiments, wherein the ampoule receptacle includes a pin for puncturing the cover.

15. The cleaning system of any one of the preceding embodiments, wherein the ampoule receptacle is at an upper surface opposite the working surface and wherein the ampoule receptacle provides a passage of the cleaning material from the cleaning ampoule to the working surface.

16. The cleaning system of any one of the preceding embodiments, wherein the ampoule receptacle receives an end of the ampoule.

17. The cleaning system of any one of the preceding embodiments, wherein the ampoule receptacle receives a longitudinal length of the ampoule.

18. The cleaning system of any one of the preceding embodiments, wherein the ampoule receptacle is at the working surface, wherein the cleaning ampoule is rotatably mounted in the ampoule receptacle.

19. The cleaning system of embodiment 18, further comprising wheels adjacent the ampoule receptacle to rotate the cleaning ampoule.

20. A cleaning system comprising:

a cleaning tool comprising a body wherein the body has a working surface with scrubbing elements and a upper surface, opposite the working surface, and wherein the body has an ampoule receptacle at the upper surface;

a cleaning ampoule containing a cleaning material, wherein the cleaning ampoule comprises a compartment at a midsection of the cleaning ampoule and a cover at at least one of a first end or second end of the cleaning ampoule for containing the cleaning material in the compartment;

wherein the ampoule receptacle is capable of holding the cleaning ampoule; and wherein the ampoule receptacle provides a fluid pathway of the cleaning material from the cleaning ampoule to the working surface.

21. The cleaning system of embodiment 20, wherein the cover comprises a punctureable film and wherein the ampoule receptacle comprises a pin for puncturing the film and providing a fluid pathway of the cleaning material from the cleaning ampoule to the working surface.

22. A cleaning system comprising:

a cleaning tool comprising a body wherein the body has a working surface with scrubbing elements and wherein the body has an ampoule receptacle at the working surface;

a cleaning ampoule containing a cleaning material, wherein the cleaning ampoule comprises a cylindrical compartment and a cover over a midsection of the cylindrical compartment for containing the cleaning material in the compartment;

wherein the ampoule receptacle is capable of rotatably holding the cleaning ampoule while the cleaning material is dispensed to the working surface from the cleaning ampoule.

23. The cleaning system of embodiment 22, wherein the cover comprises a cover wrap that is removable from the midsection leaving an apertured sidewall for dispensing the cleaning material from the cleaning ampoule.

24. A method of cleaning comprising:

providing a cleaning tool comprising a body wherein the body has a working surface with scrubbing elements and wherein the body has an ampoule receptacle;

providing a cleaning ampoule containing a cleaning material, wherein the cleaning ampoule comprises a compartment and a cover for containing the cleaning material in the compartment;

inserting the cleaning ampoule into the ampoule receptacle;

displacing at least a portion of the cover;

dispensing the cleaning material from the cleaning ampoule to the working surface.

25. The method of embodiment 24, further comprising puncturing the cover upon inserting the cleaning ampoule into the ampoule receptacle.

26. The method of embodiment 24, wherein the cover comprises a wrap over an apertured side wall of the cleaning ampoule.

27. The method of embodiment 24, further comprising:

sliding the working surface of the cleaning tool over a surface to be cleaned;

rotating the cleaning ampoule while dispensing the cleaning material.

Illustrative Embodiments: Series B

1. A cleaning system comprising:

a cleaning tool comprising a body including a working surface comprising a plurality of scrubbing elements and wherein the body has an ampoule receptacle;

a cleaning ampoule containing a cleaning material, wherein the cleaning ampoule comprises a compartment and a cover configured to contain the cleaning material in the compartment;

wherein the ampoule receptacle is capable of holding the cleaning ampoule while the cleaning material is dispensed to the working surface from the cleaning ampoule;

wherein the plurality of scrubbing elements comprise bristles, stems, hooks, or combinations thereof; and wherein the body of the cleaning tool includes a storage portion for holding a plurality of cleaning ampoules.

2. The cleaning system of embodiment 1, wherein the cleaning tool further comprises a handle.

3. The cleaning system of any one of the preceding embodiments, wherein the cleaning material comprises liquid cleaning material, a solid cleaning material, or combinations thereof.

4. The cleaning system of any one of the preceding embodiments, wherein the cleaning ampoule includes a midsection with a first end and a second end.

5. The cleaning system of embodiment 4, wherein the compartment is cylindrical.

6. The cleaning system of any one of the preceding embodiments, wherein at least a portion of the cover is displaced to dispense the cleaning material from the cleaning ampoule.

7. The cleaning system of any one of the preceding embodiments, wherein the cover is a punctureable film.

8. The cleaning system of any one of the preceding embodiments, wherein at least a portion of the cover is removable from the cleaning ampoule.

9. The cleaning system of any one of the preceding embodiments, wherein the cover is proximate at least one of the first end or second end of the cleaning ampoule.

10. The cleaning system of any one of the preceding embodiments, wherein the cover is over a midsection of the cleaning ampoule.

11. The cleaning system of embodiment 10, wherein the cleaning ampoule at the midsection includes an apertured sidewall configured to dispense the cleaning material from the cleaning ampoule.

12. The cleaning system of any one of the preceding embodiments, wherein the ampoule receptacle includes at least one pin configured to puncture the cover.

13. The cleaning system of any one of the preceding embodiments, wherein the ampoule receptacle is adjacent an upper surface opposite the working surface and wherein the ampoule receptacle provides a passage of the cleaning material from the cleaning ampoule to the working surface.

14. The cleaning system of any one of the preceding embodiments, wherein the ampoule receptacle receives an end of the ampoule.

15. The cleaning system of any one of the preceding embodiments, wherein the ampoule receptacle receives a longitudinal length of the ampoule.

16. The cleaning system of any one of the preceding embodiments, wherein the ampoule receptacle is located in between the plurality of scrubbing elements, further wherein the cleaning ampoule is rotatably mounted in the ampoule receptacle.

17. The cleaning system of embodiments 16, further comprising one or more wheels adjacent the ampoule receptacle, wherein the wheels are configured to rotate the cleaning ampoule.

18. A cleaning system comprising:

a cleaning tool comprising a body wherein the body has a working surface with a plurality of scrubbing elements, and a upper surface, opposite the working surface, and wherein the body has an ampoule receptacle proximate the upper surface;

a cleaning ampoule containing a cleaning material, wherein the cleaning ampoule comprises a compartment at a midsection of the cleaning ampoule and a cover proximate at least one of a first end or second end of the cleaning ampoule configured to contain the cleaning material in the compartment;

wherein the ampoule receptacle is capable of holding the cleaning ampoule; and wherein the ampoule receptacle provides a fluid pathway of the cleaning material from the cleaning ampoule to the working surface.

19. The cleaning system of embodiment 18, wherein the cover comprises a punctureable film and wherein the ampoule receptacle comprises at least one pin configured to puncture the film and provide a fluid pathway of the cleaning material from the cleaning ampoule to the working surface.

20. A cleaning system comprising:

a cleaning tool comprising a body wherein the body has a working surface including a plurality of scrubbing elements and wherein the body has an ampoule receptacle located in between the plurality of scrubbing elements;

a cleaning ampoule containing a cleaning material, wherein the cleaning ampoule comprises a cylindrical compartment and a cover over a midsection of the cylindrical compartment, wherein the cover is configured to contain the cleaning material in the compartment;

wherein the ampoule receptacle is capable of rotatably holding the cleaning ampoule while the cleaning material is dispensed to the working surface from the cleaning ampoule.

21. The cleaning system of embodiment 20, wherein the cover comprises a cover wrap that is removable from the midsection leaving an apertured sidewall configured to dispense the cleaning material from the cleaning ampoule.

22. A method of cleaning comprising:

providing a cleaning tool comprising a body wherein the body comprises a working surface including a plurality of scrubbing elements comprising bristles, stems, hooks, or combinations thereof, and wherein the body has an ampoule receptacle, and further wherein the body of the cleaning tool includes a storage portion for holding a plurality of cleaning ampoules;

providing a cleaning ampoule containing a cleaning material, wherein the cleaning ampoule comprises a compartment and a cover configured to contain the cleaning material in the compartment;

inserting the cleaning ampoule into the ampoule receptacle;

displacing at least a portion of the cover;

dispensing the cleaning material from the cleaning ampoule to the working surface.

23. The method of embodiment 22, further comprising puncturing the cover upon inserting the cleaning ampoule into the ampoule receptacle.

24. The method of embodiment 22, wherein the cover comprises a wrap over an apertured side wall of the cleaning ampoule.

25. The method of embodiment 22, further comprising:

sliding the working surface of the cleaning tool over a surface to be cleaned;

rotating the cleaning ampoule while dispensing the cleaning material.

Although specific embodiments have been shown and described herein, it is understood that these embodiments are merely illustrative of the many possible specific arrangements that can be devised in application of the principles of the invention. Numerous and varies other arrangements can be devised in accordance with these principles by those of ordinary skill in the art without departing from the spirit and scope of the invention. Thu, the scope of the present invention should not be limited to the structures described in this application, but only by the structures described by the language of the claims and the equivalents of those structures.

What is claimed is:

1. A cleaning system comprising:

a cleaning tool comprising a body including a working surface comprising a plurality of scrubbing elements and wherein the body has an ampoule receptacle;

a cleaning ampoule containing a cleaning material, wherein the cleaning ampoule comprises a compartment and a cover configured to contain the cleaning material in the compartment;

wherein the ampoule receptacle is capable of holding the cleaning ampoule while the cleaning material is dispensed to the working surface from the cleaning ampoule;

wherein the plurality of scrubbing elements comprise bristles, stems, hooks, or combinations thereof; and wherein the body of the cleaning tool includes a storage portion for holding a plurality of cleaning ampoules; and wherein the ampoule receptacle is located in between the plurality of scrubbing elements, further wherein the cleaning ampoule is rotatably mounted in the ampoule receptacle.

2. The cleaning system of claim 1, wherein the cleaning ampoule includes a midsection with a first end and a second end.

3. The cleaning system of claim 1, wherein at least a portion of the cover is displaced to dispense the cleaning material from the cleaning ampoule.

4. The cleaning system of claim 1, wherein at least a portion of the cover is removable from the cleaning ampoule.

5. The cleaning system of claim 1, wherein the cover is over a midsection of the cleaning ampoule.

6. The cleaning system of claim 1, wherein the ampoule receptacle receives a longitudinal length of the ampoule.

7. A cleaning system comprising:

a cleaning tool comprising a body wherein the body has a working surface including a plurality of scrubbing elements and wherein the body has an ampoule receptacle located in between the plurality of scrubbing elements;

a cleaning ampoule containing a cleaning material, wherein the cleaning ampoule comprises a cylindrical compartment and a cover over a midsection of the cylindrical compartment, wherein the cover is configured to contain the cleaning material in the compartment;

wherein the ampoule receptacle is capable of rotatably holding the cleaning ampoule while the cleaning material is dispensed to the working surface from the cleaning ampoule.

* * * * *